US007192220B2

(12) United States Patent
Gunther

(10) Patent No.: US 7,192,220 B2
(45) Date of Patent: Mar. 20, 2007

(54) APPARATUS AND METHOD TO PREPARE IN-SITU PILINGS WITH PER-SELECTED PHYSICAL PROPERTIES

(76) Inventor: Johan M. Gunther, 1247 Lincoln Blvd., Suite 140, Santa Monica, CA (US) 90401

( * ) Notice: Subject to any disclaimer, the term of this patent is extended or adjusted under 35 U.S.C. 154(b) by 0 days.

(21) Appl. No.: 10/666,409

(22) Filed: Sep. 19, 2003

(65) Prior Publication Data

US 2005/0063789 A1 Mar. 24, 2005

(51) Int. Cl.
*E02D 5/46* (2006.01)

(52) U.S. Cl. ..... 405/241; 405/240; 405/269

(58) Field of Classification Search ..... 405/233, 405/266, 269, 263, 264, 267, 258.1, 240, 405/241, 235, 232, 231, 256
See application file for complete search history.

(56) References Cited

U.S. PATENT DOCUMENTS

| | | | | |
|---|---|---|---|---|
| 4,286,900 | A * | 9/1981 | Sugimoto et al. | 405/269 |
| 4,461,362 | A * | 7/1984 | Staggs et al. | 175/325.5 |
| 4,606,675 | A | 8/1986 | Mitani et al. | |
| 4,659,259 | A | 4/1987 | Reed et al. | |
| 4,940,366 | A * | 7/1990 | Suzuki | 405/267 |
| 5,135,058 | A | 8/1992 | Millgard et al. | |
| 5,228,809 | A * | 7/1993 | Yoshida et al. | 405/269 |
| 5,542,786 | A * | 8/1996 | Blum | 405/240 |
| 5,944,446 | A * | 8/1999 | Hocking | 405/129.4 |
| 5,967,700 | A * | 10/1999 | Gunther | 405/233 |
| 6,116,819 | A * | 9/2000 | England | 405/241 |
| 6,238,142 | B1 * | 5/2001 | Harsch | 405/241 |
| 6,685,398 | B1 | 2/2004 | Gunther | |
| 2001/0045067 | A1 | 11/2001 | Cognon | |
| 2004/0175242 | A1 | 9/2004 | Kim | |

FOREIGN PATENT DOCUMENTS

| | | | |
|---|---|---|---|
| EP | 0 411 561 01 | | 2/1991 |
| JP | 57108313 A | * | 7/1982 |
| JP | 58127828 A | * | 7/1983 |
| JP | 02209519 A | * | 8/1990 |

* cited by examiner

*Primary Examiner*—Basil Kataters
*Assistant Examiner*—Gay Ann Spahn
(74) *Attorney, Agent, or Firm*—Donald D. Mon

(57) ABSTRACT

Method and apparatus to produce in-situ pilings, controllably injecting binder and water into soil formation in which the piling is to be formed, the quantities of water and binder being respective to strength demands for the piling, and to demand for water to supplement existing water to react (hydrate) with the binder.

13 Claims, 4 Drawing Sheets

APPARATUS AND METHOD TO PREPARE IN-SITU PILINGS WITH PER-SELECTED PHYSICAL PROPERTIES

FIELD OF THE INVENTION

For preparing in-situ pilings, apparatus and method to assure the concurrent presence of water and binder at known depths to cure to pre-selected physical properties.

BACKGROUND OF THE INVENTION

Structures such as roadways, railways, embankments, and levees must often be built on soil structures which are insufficiently strong to support their intended loads, immediately or after a considerable passage of time. Yet physical constraints require that these projects be built there. For example, a road must skirt a hill, pass through a meadow, or pass through a soggy a plain next to it. The alternative would be an unaffordable tunnel. Or perhaps a levee must be built next to a river to protect a city. The alternative of moving a city such as New Orleans itself so as to locate a levee at a more convenient location is not even to be considered.

Accordingly, means have been sought to strengthen existing soil structure so that when it is modified it will be able vertically to support or laterally to resist design loads that the existing soil could not have supported. One well-known technique is to mix cement or lime (or both) into the soil so as to make a stronger subsurface structure. Perhaps the best known, or at least the most frequently-encountered, example is to add a reinforcing binder such as cement and/or lime into the existing soil in a vertical bore so that when the resulting mixture cures, it forms an in-situ piling. This piling is thereby constructed of the existing soil as an aggregate plus the added binder. Of course, the ultimate strength of the piling can be attained only if water already exists along with the aggregate, or is supplied when the piling is formed. The ultimate objective is to make a cementitious stoichiometric mix of water and binder that will in time harden to its best properties.

In addition, the strength properties of the piling depend strongly on the amount of binder supplied to it. A stoichiometric mixture merely requires sufficient water to cure the amount of binder that is supplied.

An example of in-situ piling is shown and described in applicant's U.S. Pat. No. 5,967,700 issued Oct. 19, 1999. It is the sense of this patent to know the need for water at various elevations in the intended structure, and to mix it in with the existing soil on the way down into the soil, and then on the way up, to mix in the necessary amount of cement or lime to form a piling of desired characteristics.

Such pilings, and also those made with the present invention, should not be confused with conventional pilings that are prepared off-site. Conventional pilings brought to the site are then and there driven into the soil. These are sometimes lengths of timber. Other times they are poured and cured concrete structures, all with very substantial compressive, shear, and fracture strength. They do not integrate themselves in the soil structure into which they are driven, nor do they include any part of the existing soil in themselves. Instead they exist as free-standing foreign bodies. They are costly to manufacture, transport to the site, and drive into the ground. Their cost, and to a surprising extent, their excessive physical properties lead engineers to use them sparingly. For piers, building foundations, and the like, their use is economically justified. However, to provide many of them per mile for many miles of a roadway or levee can rarely be justified. Also, their inherent strength is much greater than needed for purposes of this invention.

The preparation of an in-situ piling is inherently less costly than the use of a piling prepared off-site. It requires only an auger/mixer to drill into the soil structure and inject and mix materials which, along with whatever soil is already present, will hopefully cure to a solid in-situ vertical piling which has stronger properties than the surrounding soil. Furthermore, its boundaries with surrounding soil structure will not be as abrupt as those of a driven piling. Instead, when properly made, the boundary is likely to be a gradual transition. These are fundamental considerations when one decides to provide an in-situ piling, and how to make it.

The genuinely surprising fact exists that in practice in-situ pilings have not been built to their anticipated strength levels, even when these levels were known, which is not necessarily a uniform property throughout the depth. In fact this shortcoming has not been widely noticed, nor in most practice has it been recognized as a problem. Generally the concept has been to put a calculated amount of a binder in the bore, mix it into the soil, and leave.

The necessary properties of an in-situ piling are surprisingly less than those of a driven piling, only in part because they do not have to withstand driven forces. Prominent among reasons for this is because they usually have a very much larger cross-section. It is not unusual for an in-situ piling to have a diameter as great as 36 inches, while a driven piling usually will be no larger than 18 inches in diameter, in large part because of the substantial skin friction that must be overcome to sink a piling. In-situ pilings do not face this problem. There is no skin friction to resist driving forces.

Also, because of their lower and affordable cost, there can be many more of them.

Compressive strengths as low as 40 psi are considered to be acceptable for many in-situ pilings, which may be as deep as 60 feet. Interestingly, these may be prepared in as short a time as 5 minutes. Thereafter they cure in times calculated in hours or days. Driven pilings are simply unable to compete with such a pace.

There are two basic generally-used methods to form in-situ pilings: the wet and the dry. The wet method injects a slurry of water, cement and/or lime into the bore as the auger either enters or leaves the bore, or at both times. The auger itself rotates vanes which both drill into the soil and mix the soil and injected slurry. The slurry is prepared in a mixing plant located on the surface. It is fed under pressure to the auger through pipes and hoses. The slurry is forced under pressure from the auger into the soil. It enters the soil as a strong stream. If the soil is dry, then a slurry injected and mixed into it would appear to be an ideal arrangement.

However, there are several serious disadvantages to this arrangement. The slurry in the lines, if permitted to stand too long such as during an interrupted operation for a substantial time, or overnight, will harden in the system. Then the system itself must be taken apart and cleaned out, or parts must be replaced as necessary. Also, unused slurry must be disposed of at the end of a work shift. This becomes an ecological problem. These are disadvantages at the surface and in the equipment. They do have the advantage that they can be "fixed", but at a substantial cost.

The subsurface problems with the wet method are more severe. They are even more worrisome because they can and often do result in a deficient piling. Slurry to be pumpable and mixable in the soil must have some known amount of water of its own. If the amount of water in the slurry plus water in the formation is sufficient for hydration of the amount of cement and lime, then an in-situ piling formed with it in dry soil could be proper. The usual situation is that most soil (but far from all) has useful water in it, although not at all depths, and it can occur at different wetness at various depths.

Accordingly, a slurry of constant properties and composition can end up either not diluted or diluted to an unknown or excessive extent, unless it was precisely constituted for the immediate depth in the formation, which cannot effectively be done with mixing equipment at the surface which must be a continuous operation with long hose lines filled with already mixed slurry. In designing an in-situ piling using the wet method, the engineer must either accept a minimal load value or an over-design. Then he must overpay for a larger piling, or for more pilings, or for extra binder, all of which can be prohibitively costly. These are serious disadvantages in days when money is short. Design criteria in excess of real requirements can not be tolerated, but is, in the absence of an alternative.

The dry method has even more severe restraints and consequences. In this method, dry cement and/or lime is mixed into the bore through the auger while the auger drives into the soil and stirs it. Existing water is relied on for the curing. Sometimes water is injected into the soil, but attention is rarely given to the variability of wetness at various depths. As a consequence, examinations of many completed in-situ pilings show various properties at different depths, extending from almost negligible strength near the surface where it is likelier to be drier, to excessive water potentially leading to reduced strength at depths where there was a deleterious excess of water when the piling was formed.

Applicant has developed a third method, with which he assures that at all pertinent depths there will be sufficient water to react with the binder he supplies, and also that there will be a proper amount of binder at each depth. The amounts of binder and of water supplied by this third method can and often will vary for depth to depth.

The objective is to produce at each depth a column having strength and dimensions suitable for each respective depth.

While so doing, energy loads on the equipment are significantly reduced. This is especially the situation when the soil is dry. Rotating and driving an auger in dry soil requires a substantial effort. The introduction of the water provides lubricity which reduces the energy load to drive the auger.

A further disadvantage of the prior art is the method of injecting the binder. It is customarily injected into the bore by a compressed air stream. The problem here is the distribution of the binder when it arrives in-situ. To obtain the best piling the binder should be evenly distributed, but pneumatic propulsion of a dry powder into a variable region often results in uneven distribution because of the nature of the formation into which it is injected. It may shoot all the way to the edge of the bore, or may be stopped quickly and never go very far into it. It then is the task of the auger to correct this by proper stirring of the entire mixture.

Applicant has found that the preparation of in-situ pilings with consistent and known properties depends heavily on the distribution of the water and binder in the bore, on the accurate and known presence and supply of each, and the nature of the soil in which the piling is formed. It must be kept in mind that while this process is relatively rapid, it still takes some time. For example, a 60 foot deep piling completed in five minutes requires axial auger movement at the rate of about 24 feet per minute. The usual rate of rotation of the auger is between about 150–250 rpm. Thus the auger travels axially at between about 15 and 30 mm per revolution. Accordingly, the binder is injected at a fairly rapid rate. However, its distribution and the water content of the soil at the point of injection is dependent on the nature of the soil—it is more difficult to penetrate clay than sand or sandy soil, for example, while in sandy soil water may drain quickly. Therefore, especially when fast-setting binders are used, there is the risk of earlier agglomeration of binder and water, and for slower-setting binders of a lesser amount of water because some water may have drained away. The injection of dry binder can vary also with the existing water content of the soil.

As to the addition of water, it is observed that the most troublesome situation occurs in sand or very sandy soil, from which existing and especially added water may drain away in important amounts before it is contacted by the binder. Thus, it is not only important to assure the presence of known amounts of water at various levels, but to have them there when the binder is added.

It is an object of this invention to provide process and equipment to enable local control over the injection of water and binder, and in such a way that the water and binder are in place in correct amounts at the time and place where they are to cure, and to mix them there. This invention provides the advantages of the wet method, but creating a slurry locally without the disadvantages of the wet method.

BRIEF DESCRIPTION OF THE INVENTION

The method of the invention comprehends adding, at least at some levels in the bore of an intended in-situ piling, water and binder in amounts sufficient along with existing water that when cured to create with the existing soil used as aggregate, an in-situ piling of desired strength characteristics will result. It is intended that after the auger has passed both up and down, there will remain a well-mixed mixture which when cured will from top to bottom fulfill the intended structural requirements at all depths.

According to this invention, water and binder, both as required at the various depths, are supplied separately, under separate controls, to functionally nearby injectors. Each injector is separately controlled to deliver on demand water or binder, respectively, and in a direction and location whereby the water and binder will meet timely after exiting the respective injectors. Accordingly, there is a timely meeting of these ingredients, well before water could drain away, and well before dry binder could blow through an otherwise too-dry formation. Instead there results, nearby to known locations on the tool, timely close to the moment of separate injection of the water and binder, a properly proportioned supply of water and binder respective to conditions as they exist at the very depth in the bore.

According to a preferred but optional feature of this invention, the functionally related injectors are so disposed and arranged such that their emissions (the injected water and binder) meet locally within so short a time that they are in a desired location and become mixed quickly.

According to still another preferred but optional feature of the invention the functionally-related injectors are companion injectors whose emissions intersect close to their exits.

According to another preferred but optional feature of the invention, a plurality of companion injectors are disposed along an auger vane, so that the initial injection of these ingredients is at a plurality of regions spaced from the central axis of the piling.

According to yet another preferred but optional feature of the invention, the rate of supply, and thereby the quantity of supply of water and of binder at respective depths is maintained such as to provide at the respective depth an anticipated desired mix of soil (aggregate), binder and water and if desired, of additives such as sand.

The above and other features of this invention will be fully understood from the following detailed description and the accompanying drawings, in which:

DETAILED DESCRIPTION OF THE INVENTION

Figure 1:
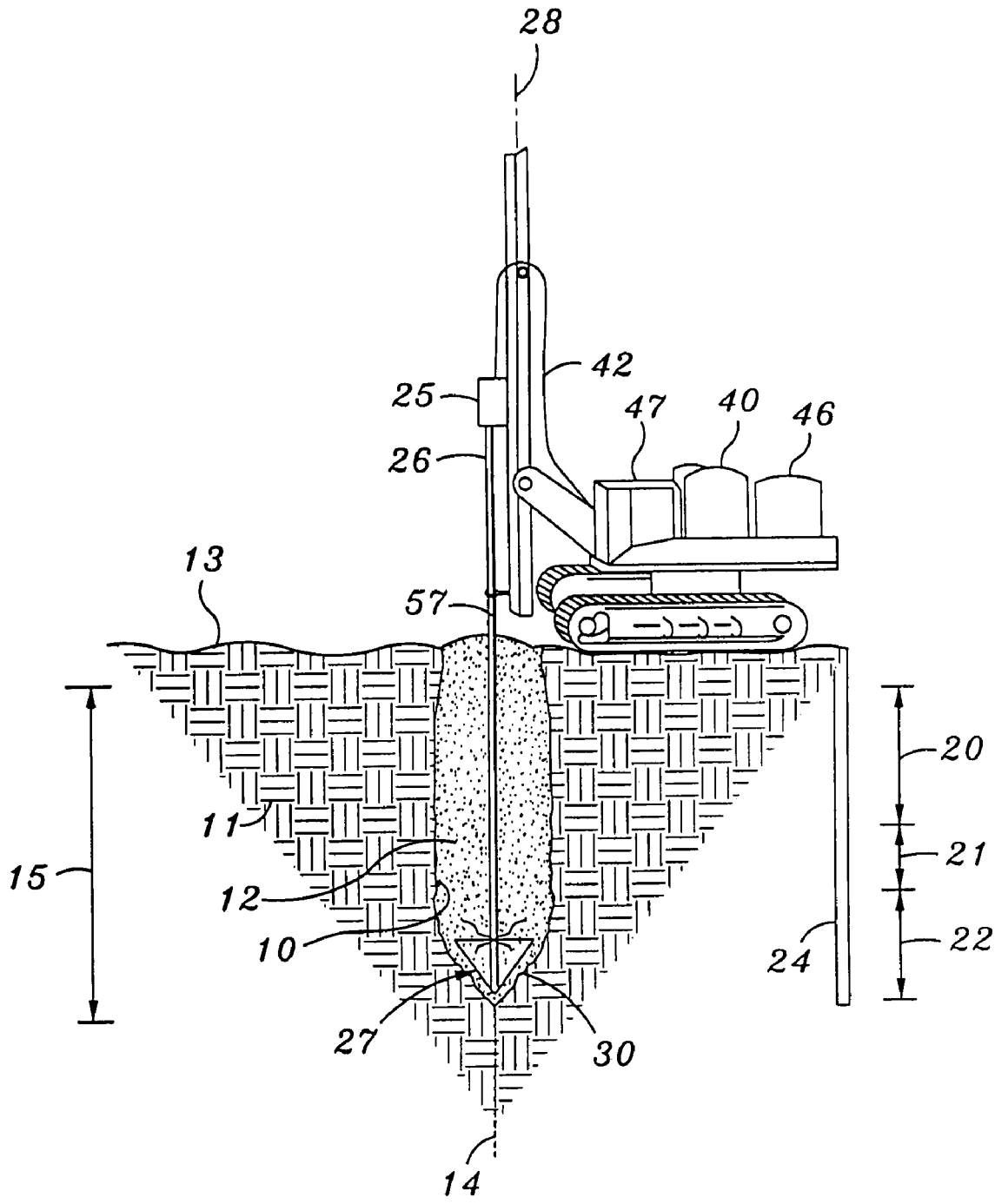
FIG. 1 is a schematic view partly in cross-section showing the use of this apparatus.

This invention is used to reinforce a region 10 in a soil structure 11. Structure 11 may be of any constituency, from sand to sandy to clay, which without reinforcement would not provide sufficient support for an intended usage. Such usages could include vehicular roadbeds, dams and levees as examples.

Such soils can vary widely in composition and structural quality. While the gross composition of the soil material at a given depth often will be reasonably consistent over a large area, the water content can and often will vary remarkably from depth to depth, and between adjacent regions. It is not uncommon for a vertical bore to be quite dry for a number of feet in depth, then to become wet, and perhaps dry again.

A failing of the existing piling art is that the same amount of cement is often injected at every depth, without regard to the existing water content. Providing binder which is not reacted reasonably promptly provides little ultimate structural advantage. For this reason, many unearthed in-situ pilings are found to be essentially unreinforced because the binder did not cure, or was only locally reacted, which used up all of the available water.

Similarly, in very pervious formations, such as very sandy formations, supplied water may have drained away before being useful to the binder for curing purposes.

The terms "curing" and "hydration" are used interchangeably in this specification. It means whatever reaction occurs in the hardening of a powdered binder such as cement and/or lime to form from a mixture of water and powder in to a body that acts as a "paste" to bind aggregate together as a solid body. The precise chemical nature of the reaction is not important what is important is the solid result, often spoken of as a cured or hydrated body.

The objective of this invention is to produce in soil structure 11 an in-situ piling 12 that extends as a cylinder below the ground surface 13. The piling has a central axis 14, and a dimension of depth 15.

While there are many structures in which the soil constituency is constant from the surface, many or most will have different soil or water compositions, especially as to water content at different depths. For example, an upper zone 20 may be quite dry, while lower zone 21 may be wetter, and lower zone 22 still wetter. The constituency and wetness of these zones can be learned from cores drawn from borings 24 taken at locations near to one or more places where a piling is to be made.

The ultimate strength of a binder-reinforced in-situ piling is a reasonably proportional function of the amount of binder per unit of volume. The designer will sensibly use the minimum amount of binder that will create the desired strength, because the binder is the largest cost. Whatever amount of binder is provided for a given amount of aggregate, and provided that sufficient water is available fully to react that binder, the intended strength will be developed with the use of least binder.

The term "stoichiometric" is used herein to denote the presence of sufficient water to result with the binder in a solid and reasonably consistent body. With some cements, completion of the reaction may take a very long time, measured in months. This method may or may not provide all of the water ultimately needed, although it may do so. It will, however, provide sufficient water that the in-situ piling will cure in a reasonable time to a strength consistent with the design criteria. It may or may not strengthen beyond that time, which will usually be measured in days. "Stoichiometric" does not exclude additional water. The precise amount of water needed for hydration, as the only water, is not the exclusive meaning of the term. Additional water merely dilutes the system. Provided that water is not in such a large immediate quantity as to "kill" the binder by preventing it from forming the type of binding matrix intended, excess water content is still within this invention.

Also, the term "water" as used herein is intended to comprise water that is available for sufficient hydration (or curing) of the binder of the body. It may be free water existing between particulates of the aggregate, or even loosely bound water more available to the binder than to whatever else it was bound to.

The basic equipment required to carry out the process of this invention is a rotary power source 25 on the surface adapted to rotate shaft 26 of an auger 27 around a central axis 28. The power source also has the capacity to thrust the auger axially downwardly into the ground to a selected depth and then to raise the auger to the surface.

The auger itself has a head 30 (FIG. 2) with outwardly-extending vanes 31 that meet at the center 32 of the head. These vanes act as a drill during downward movement. They also serve to stir the loosened aggregate.

Figure 6:
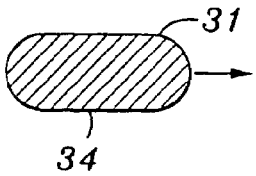
FIG. 6 is a cross-section taken at line 6—6 in FIG. 2.

While an auger is often thought of as a drill, progressing through the formation by a given increment for each revolution, this is not a precise definition. A practical auger may have, but often does not have, a sharp leading edge. Instead the leading edge 33 (FIG. 6) is likelier to be rounded, and the trailing bottom surface 34 rather flat. Progress through the soil often involves axial compression beneath the vane so the vane sinks into the soil a bit, and as it rotates this material passes over the top of the vane.

While not a precise screw thread pitch, the passage of the auger still is along a generally helical path, although the pitch may vary somewhat along with the length of the bore depending on the composition of the soil. What is important is that as the auger progresses, it generates a volume of loosened soil which it also stirs. It is into this loosened, helically shaped region where at its depth the water content is known, and frequently also the nature of the soil, that binder and water will be added.

Usually the rotation of the shaft will be reversed when the head is to be returned to the surface. The vanes will further stir the mixture as they return to the surface.

The structure as illustrated is greatly simplified. For example, additional vanes can be added for stirring purposes, and the angle of attack of the vanes can be selected differently for raising and lowering. These considerations are entirely standard in this field.

The object of this invention is to be certain that at all depths at least the stoichiometric amount of water is available for the amount of binder injected at various depths, that the correct intended amount of binder is injected, and that the binder and such additional water as may be supplied will be properly distributed and supplied temporally such that the water and the binder are locally in place in the correct amounts at or very quickly after the moment or moments of injection. The binder and the water will be injected in such a way as to be available throughout the structure, and will not be unduly concentrated or agglomerated in localized places.

It is also an objective that the system, especially the tool, will not become plugged if the system shuts down abruptly.

For those purposes, in the preferred embodiment (FIG. 5), companion injectors 35,36 are provided in pairs at one or more locations and in numbers of pairs to be described. Injectors 35 are to provide binder, and also if desired additives such as sand. Injectors 36 are to provide water. Each injector has a respective discharge axis 37,38. These axes intersect under in-situ (ambient) pressures adjacent to but spaced from the shaft and where their materials mix, they have a combined component of radial motion. They meet in a limited region which under some circumstances can be regarded as a "premix" region.

Water supply 40 at the surface provides water under pressure from a pump 41 to the tool through a conduit 42 that passes down the shaft and out to an injector or injectors. A water control valve 43 (FIG. 8) regulates the flow of water under control of a program 44 which may be manually or computer-controlled as will later be described. This valve determines the rate of flow, and thereby how much water is to be supplied at the current depth of the injectors in the bore.

A binder supply at the surface provides binder under pressure from a pressurized supply source 46 to an injector through a conduit 47 that passes down the shaft and out from injector 35. The amount of binder will be under control of a binder control valve 48 (FIG. 8) which can be manually or program controlled. The binder will usually be granular or a powder, so that it can be transported by air pressure. If desired, the binder can be pre-moistened, but this risks clogging of the lines.

While the binder will usually be cement, lime, or a mixture of them, of many also include other ingredients such as sand.

The intended function and advantage of companion injectors is the very close proximity of the intersection of their discharge axes. When their injected streams meet, preferably within a few inches of their exit from the injectors, wetting and hydration of the binder begins immediately. This provides most of the benefits of a slurry system, but because the supply lines are separate, there will be no clogging if the system stops. Furthermore, because the streams meet, preferably at an acute angle, the resulting mixed stream 38*a* will have a radial Speaking generally, in-situ pilings larger than 36 inches in diameter will be rare. More commonly, they will be on the order of about 18 inches in diameter. The central shaft must be capable of driving its vanes to a depth of up to about 60 feet, although shallower pilings will be more common. Even so, the shaft must have sufficient strength to exert the necessary torque and also to press the vane or vanes into the soil while driving it in on direction, and reversing the torque while pulling the tool out of the bore.

The shaft will, or course, accommodate the supply lines, which, especially for the dry binder, must have a substantial cross-section. Internal diameters of the shaft will ordinarily be on the order of three inches. The wall thickness of the shaft and its physical properties will be selected to enable the torque and axial loads to be exerted without undue twisting or distortion of the shaft.

In such an arrangement, companion injectors will preferably be located within about three inches of one another and their streams will be so directed as to intersect within about three to six inches from their injectors. Their intersecting streams will meet and mix in a limited region such as region 39 so as to produce a mixed stream of binder and water formed of water from the injector. There or shortly beyond it, it will mix with water already present in the bore.

The mixture in region 39 can properly be denoted as a "premix", that is, a mixture of binder and added water, which, with the next addition of existing water will result in the desired piling.

Figure 2:
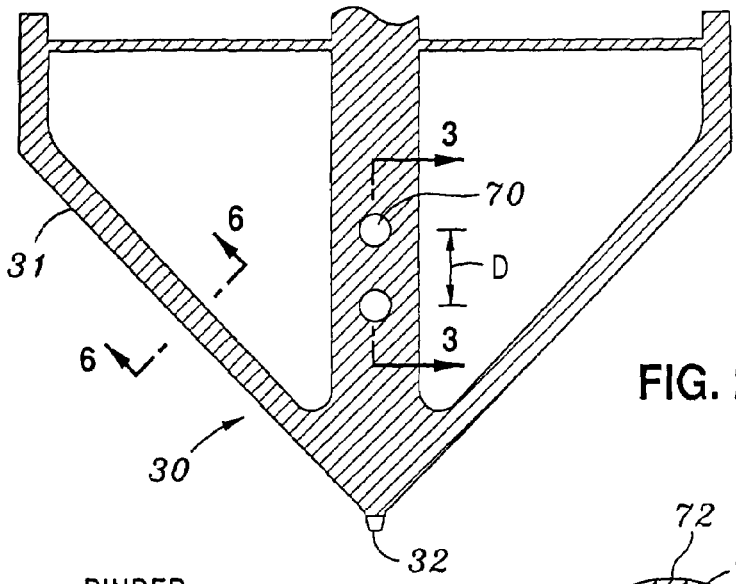
FIG. 2 is a side view of the vane shown in FIG. 1.
Figure 3:
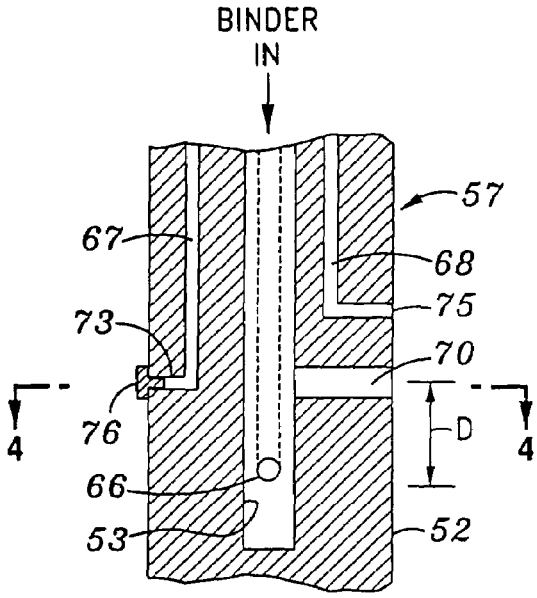
FIG. 3 is a fragmentary cross-section taken at line 3—3 in FIG. 2.
Figure 4:
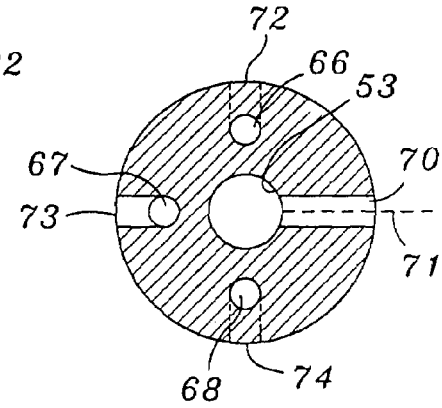
FIG. 4 is a cross-section taken at line 4—4 in FIG. 3.
Figure 5:
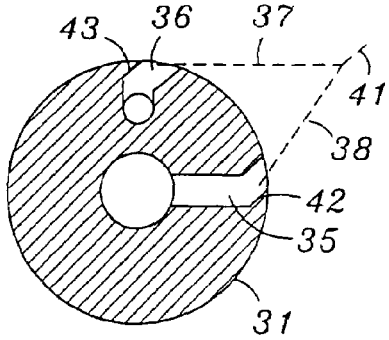
FIG. 5 is a cross-section showing a modification of the injectors.

If the shaft of FIG. 2 is to be used, then as shown in FIG. 5, deflectors 42*a* and 43 will divert their streams toward one another to mix in region 39.

Figure 7:
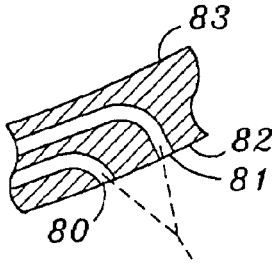
FIG. 7 is a fragmentary cross-section of part of an optional vane.

Injectors 80 and 81 may be set in the shaft, or they may be set in a vane as shown in FIG. 7. Then their streams, instead of facing outwardly into the bore, will face forwardly into the formation, ahead of the vane. With such an arrangement, the mixed stream can also serve as a better lubricant for the vane as it cuts into the soil.

FIG. 7 shows a water injector 80 and a binder injector 81 set in the leading edge 82 of a vane 83. As a further advantage, the water injector may be placed and supplied so as to contribute cutting jets to facilitate entry into the soil.

Companion injectors (a related pair) may be regarded as a special and preferred example of "functionally-related" injectors. Companion injectors emit their material in such a way that their emissions intersect and promptly mix in-situ. Alternatively, emissions from functionally-related injectors need not directly mix as streams, but instead can be discharged into the soil as separate streams whose injected materials in the soil are placed sufficiently closely in time and dimensions that they can promptly be stirred by the tool in a "temporal" relationship. Such an arrangement can enable the use of a simpler tool.

A simple system utilizing functionally-related injectors is shown in FIGS. 1–4 in which functional, but not companion injectors are used. This enables the use of the system with only a modification of its drive shaft, does not require modification of the vanes themselves, and does not require immediate intersection of the stream of water and of binder.

Drive shaft 51 is a hollow cylinder with a peripheral wall 52 and a central passage 53. Vanes (not shown) are driven by the shaft as in FIG. 1. Water supply pipe 42 leads from the water supply to the tool head.

Binder supply pipe 47 leads from the binder supply to the tool head.

The tool head is coupled to the water and binder supplies by a rotatable coaxial collar (not shown) which provides binder at the center, and water at an annulus. This enables a binder connection to be made to central passage 53, which acts as a binder passage, and water connections to four drilled axial water passages 66, 67, 68, and 69. The number four of these water passages is arbitrary but convenient to provide water injectors at various axial locations.

A binder injector 70 (FIG. 2) is drilled through the wall into the binder passage. Preferably its discharge axis 71 is normal to the axis.

Water passages 66-69 have respective water injectors 72, 73, 74, and 70 which also discharge radially. Selection of which injector or injectors is to be used can be determined by inserting a removable plug 76 in those to be closed. These water injectors are located at selected locations relative to the binder injector. For example, it will be noted that these water injectors can be, and in the drawings some are, pointed in opposite directions from the binder passages. They may or may not be located at the same elevation along the central axis. Thus, the emission streams from these injectors will not directly intersect. However, as will be seen, they inject their streams at such close locations and times that when a "following" stream arrives at some depth, it will soon enough encounter material from a previous stream in a condition and quality ready for complete mixing, for example, before water can drain away, such as through a sandy formation.

There is a substantial range of locations of functionally related injectors. Their purpose is not necessarily to provide intersecting streams, but instead to provide their streams in a way such that one of them will, quickly enough, encounter the material emitted from the other.

For example, consider that the vanes drive into the soil in a manner similar to a screw thread. It would advance much as a thread, with a "pitch" dimension. That is, the tool would advance an axial distance equal to the pitch for each revolution. This pitch may vary for the same rpm, depending on the characteristics of the soil, but it is a useful analogy.

In actual practice, a tool of this type is pressed into the ground rotating at a selected rate between about 150–250 rpm. For convenience assuming the rate is 150 rpm, and the pitch is 1.0 inch, it will require about 0.8 seconds for the tool to advance one inch. Now if the first nozzle, whether water or binder, is axially spaced from the next nozzle above it by a distance D, this next nozzle will arrive at the same axial location as the former one in 0.8 seconds times the axial spacing of the two nozzles.

Thus, if the nozzles are spaced 10 inches apart and the pitch is one inch, the next nozzle will discharge its contents at the respective point in about 8 seconds. If the spacing D is shorter the time will be shorter. If the rotation is faster, the time will be shorter. If it is slower, it will take longer.

These temporal relationships are closely coupled. In most soil structures one can anticipate that a time spacing of less than about 10 seconds between injection of water and binder into the same region will result in the near equivalence to a slurry, and is intended by this invention. Here it will be commented that the same vanes which dig into the soil also will serve to stir it. When the auger is withdrawn it will stir it again.

When the streams directly intersect, the mixing is immediate. When they are suitably spaced and directed, the resulting mix will closely resemble a slurry. The forgoing examples are illustrations of a convenient tool, where the streams are radial, perhaps oppositely directed.

In a tool as shown, axial spacing of the nozzles of 10 inches or less, preferably two or three inches, or even at the same elevation, will usually be used.

Figure 8:
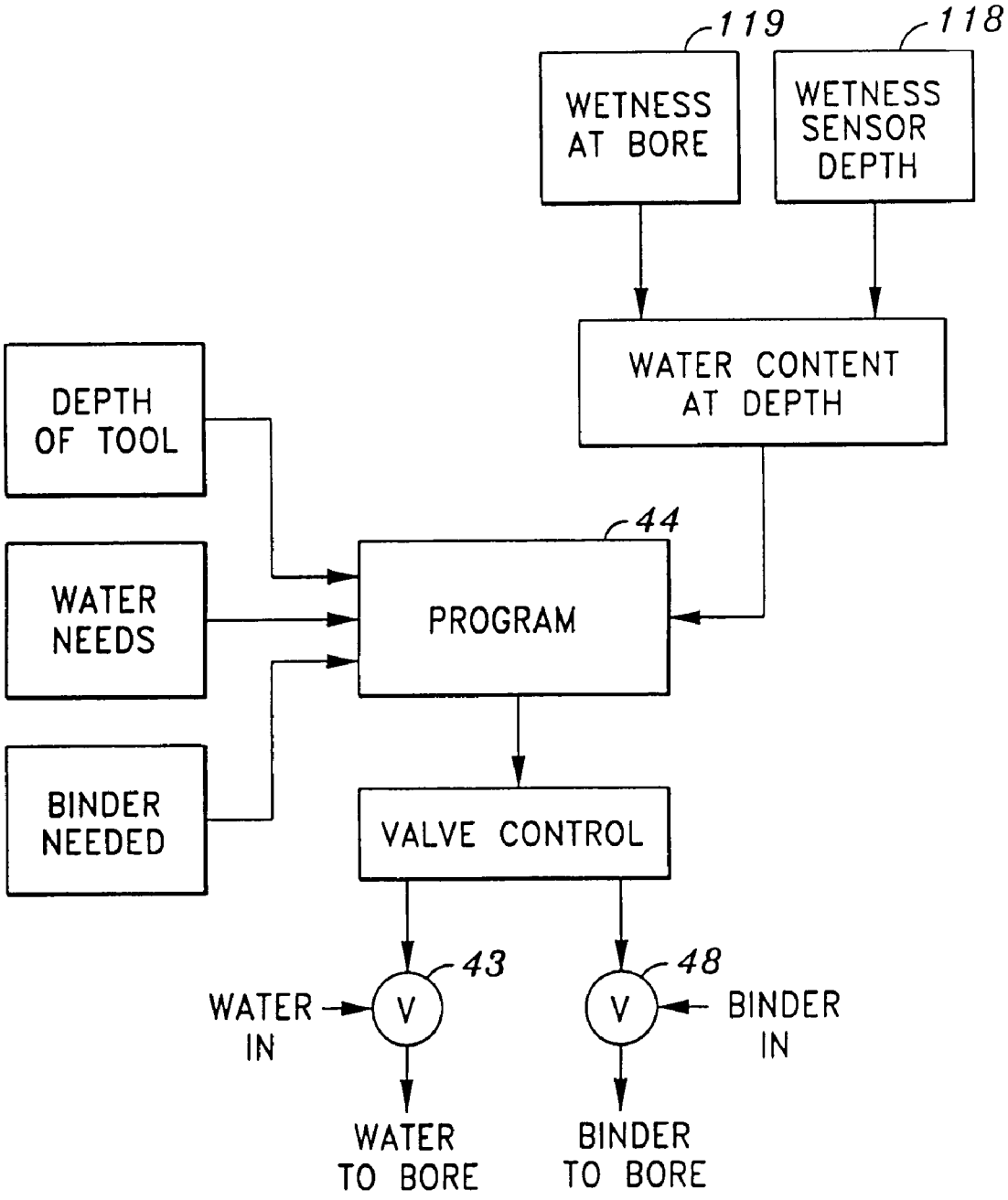
FIG. 8 is a flow chart illustrating the method of the invention.

FIG. 8 illustrates the method of this invention. The amounts of water and the binder to be supplied are tailored to conditions of the soil and to the available water content. This data is known from the test bore, or from measurements made currently with the making of the piling, such as by a sensor on the leading end of the tool.

The depth of the tool in the soil formation is known by the operator from direct observation of the tool shaft and from readouts which are respective to tool depth. These are entered into the program, and the water and binder will be supplied by adjusting valves 43 and 48 controlled by the program. Thus, as the tool progresses downwardly (or upwardly) the materials are supplied to create the mix desired at that depth.

Figure 9:
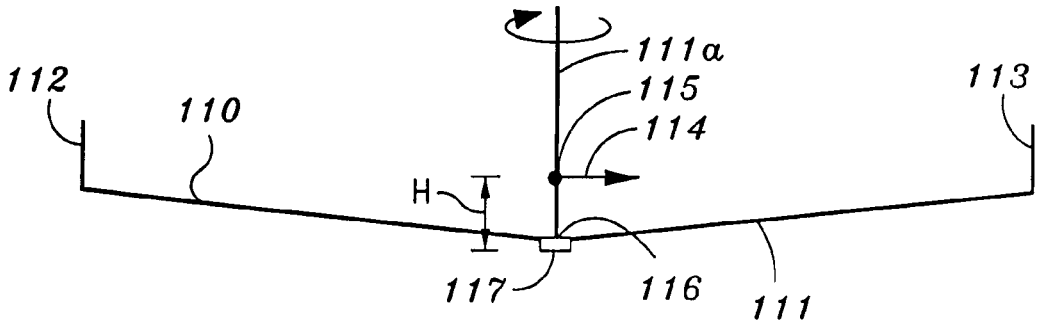
FIG. 9 is a schematic cross-section explaining the method of this invention.

FIG. 9 schematically illustrates several other features of the invention. Vanes 110 and 111, similar to vanes 31 are driven by a central shaft 111*a* similar in function to shaft 51.

Vanes 110, 111 include respective baffles 112, 113 which are generally aligned with the mutual output emissions 114 of injectors 115. The purpose of these baffles is to keep the emissions within the region of the intended piling. These baffles are preferably located at or near the intended boundary of the piling.

The emissions are shown emitting at a height H above the vertex 116 of the vanes. At or near this vertex may be water-content sensor 117. This sensor informs the central system about the available water content of the soil at a depth below height H. Thus, this data 118 can be transmitted to the control system of FIG. 8 to provide the proper amounts of water (or binder) at a depth yet to be treated by the tool.

Figure 10:
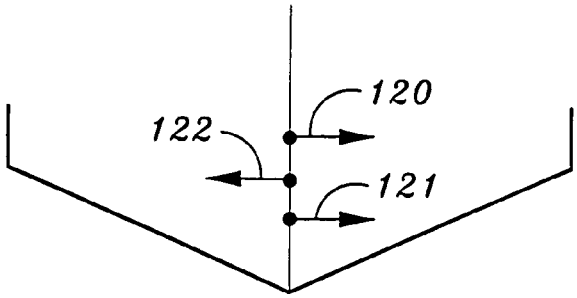
FIG. 10 is a schematic sketch showing structure for an optional pattern of injection of water and binder.

FIG. 10 illustrates an advantage of this arrangement. Here a binder injector 122 is disposed axially between two water injectors 120, 121. With this arrangement, water may be the first-injected material, or instead the binder may be. Generally it will be preferred to inject the water first. In addition, this arrangement enables a selection of order of injection on the way up, or down if additional injection of binder is desired in that direction, or if all binder is to be injected in that direction.

It will be observed that the wetness at depth data 119 known from a bore will be used if available, or if not available, then data from the sensor on the tool can be used.

Figure 11:
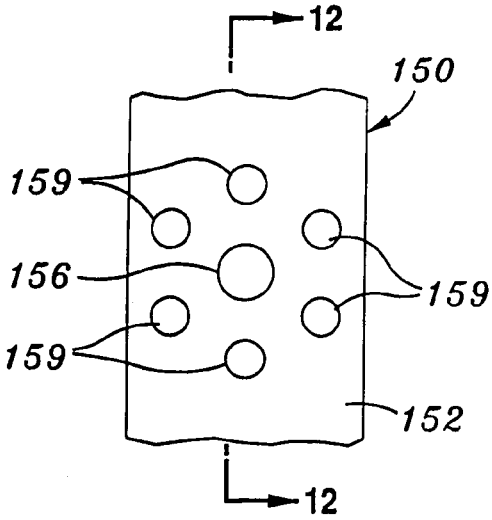
FIG. 11 is a fragmentary side view of a portion of the auger showing a different injection arrangement.
Figure 12:
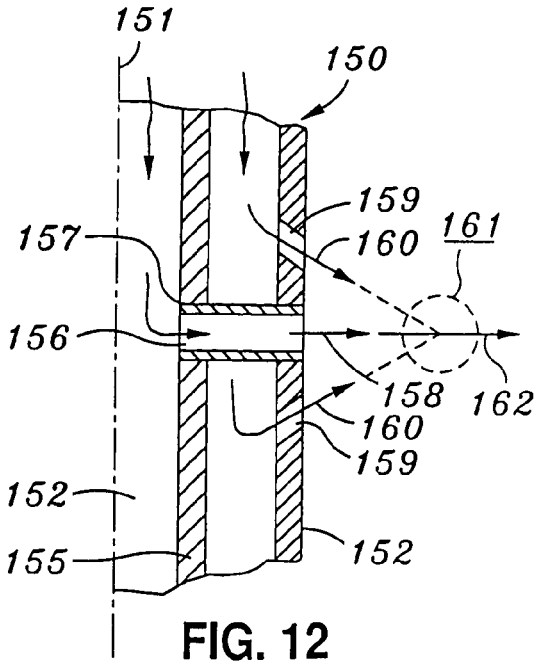
FIG. 12 is an axial half-section taken at line 12—12 in FIG. 11.

Another example of companion nozzles is shown in FIGS. 11 and 12. In this arrangement outer shaft 150 drives the tool. It has a central axis 151 and a peripheral cylindrical wall 152.

An interior coaxial and concentric binder tube 155 has a central passage 152*a* to deliver binder. A nozzle 156 extends through an opening 157 in the wall of tube 155 and through an opening 157 in wall 152. As best shown in FIG. 12, it delivers binders laterally along an axis 158.

A group of water nozzles 159 are formed through wall 152. These nozzles emit water along axes 160. As shown in FIG. 12, axes 160 will intersect axis 158. This is similar to a shower head, in which a central stream is impinged upon by a plurality of other streams. These nozzles may provide a very beneficial effect when the tool is withdrawn from the bore. The water nozzles may be opened to form a spray pattern that will catch any binder dust that may leak from the binder nozzle, preventing a cloud of dust from forming. For this purpose the water nozzles may be turned on, while the binder nozzle is off.

Importantly to this invention, the streams intersect within a limited region 161, and from there proceed radially along path 162.

When streams 158 and 160 intersect, they will carry all of the binder, and such water as is needed to supplement the water already in the formation. Therefore the material in region 161 can properly be regarded as a "premix". When added to the water already present in the formation the correct composition for an in-situ piling will have resulted and will be stirred by the tool.

This invention thereby provides most of the advantages of a slurry, but without the slurry's serious disadvantages. The water and binder (cement or lime usually, or both) are kept separate until they enter the formation, where they are promptly stirred together in the correct amounts.

It should be noted that all addition of water and binder is injected into a region at "ambient" pressure. Ambient pressure is defined as the fluid pressure in the region where the material is injected. Often it is close to atmospheric pressure, but may be somewhat higher depending on local conditions.

What is important is that the pressure at the nozzles is higher than ambient, so the material can be injected into the formation. But it also is important because water or binder or their mixture cannot flow backward into the nozzles and into the system. Thus, the system is self-cleaning, and avoids the problem involved in pumping a slurry.

Downhole valving can be provided, especially for the water, but for the binder will lend a complexity that is undesirable. Maintenance of super-ambient pressure in the supply lines will guard against back flow. Removal of pressure sufficient to drive the binder or water will prevent back flow and if not excessive, will not drive binder out of the nozzle.

Water can be valved directly by the operator, now of desired, appropriate valving can be provided downhole.

Sand when used with binder may be regarded as a diluent to and part of the binder.

This invention is not to be limited by the embodiments shown in the drawings and described in the description, which are given by way of example and not of limitation, but only in accordance with the scope of the appended claims.

I claim:

1. A rotary tool for drilling into a soil formation from its surface, controllably injecting water and dry binder at known depths below the surface of said formation, and mixing said soil, water and dry binder to form an in-situ piling, said tool comprising:

a rotary shaft having a central axis of rotation adapted to be driven bi-directionally around said axis, and bi-directionally along said axis;

a vane on and extending radially from said shaft to be rotated around and moved axially by said shaft, said vane being so disposed and arranged as to move through the formation along a helical path to drill into said formation, to stir the material of the formation, and ultimately to mix the material of the formation with water and dry binder;

a water injector and a binder injector carried by said tool, each injector having a respective axis of emission of water or of dry binder, said axes of emission being directed away from said tool into said formation at a respective location along said central axis;

said injectors being so disposed and arranged relative to one another that the material of their emissions will during a limited number of revolutions of said shaft, encounter one another, there to be mixed as a predetermined ratio of water and of dry binder, said water including water emitted from the water injector and water which may have already been present at that location;

said injectors being set in said shaft with their axes of emission substantially normal to said central axis, and located along said central axis such that the emission of one of them will, within a limited number or rotations of the shaft encounter and mix with the other in a temporally suitable time related to the curing of the binder and drainage of the water;

there being a pair of said water injectors and at least one of said binder injectors set in said shaft, with said binder injector located axially between said water injectors.

2. In combination:

a rotary tool for drilling into a soil formation from its surface, controllably injecting water and dry binder at known depths below the surface of said formation, and mixing said soil, water and dry binder to form an in-situ piling, said tool comprising:

a rotary shaft having a central axis of rotation adapted to be driven bi-directionally around said axis, and bi-directionally along said axis;

a vane on and extending radially from said shaft to be rotated around and moved axially by said shaft, said vane being so disposed and arranged as to move through the formation along a helical path to drill into said formation, to stir the material of the formation, and ultimately to mix the material of the formation with water and dry binder;

a water injector and a binder injector carried by said tool, each injector having a respective axis of emission of water or of dry binder, said axes of emission being directed away from said tool into said formation at a respective location along said central axis;

said injectors being so disposed and arranged relative to one another that the material of their emissions will during a limited number of revolutions of said shaft, encounter one another, there to be mixed as a predetermined ratio of water and of dry binder, said water including water emitted from the water injector and water which may have already been present at that location;

a control valve respective to each of said injectors, whereby the rate of supply of water and of dry binder can independently be regulated by said control valves to provide binder at a rate desired at a respective depth and water at a rate desired which with existing water already in the formation at that depth, will constitute at least sufficient water for stoichiometric reaction of the binder;

said injectors being set in said shaft with their axes of emission substantially normal to said central axis, and located along said central axis such that the emission of one of them will, within a limited number of rotations of the rotary tool encounter and mix with the other in a temporally suitable time related to the curing of the binder and drainage of the water.

3. The method of forming an in-situ piling in a soil formation with a dry binder and sufficient water to produce a stoichiometrically correct mixture, comprising:

with a rotary tool, drilling into said formation, said tool having a rotary shaft that has a central axis of rotation and a vane for drilling into and mixing the soil, rotated around and moved axially by said shaft, said vane being so disposed and arranged as to move through the formation along a helical path to drill into said formation, to stir the material of the formation, and ultimately to mix the material of the formation with water and binder;

a water injector and a dry binder injector carried by said tool;

driving said tool axially into and out of said formation while rotating it;

at some times during axial movement of said tool, simultaneously discharging said water from said water injector into said soil formation along an axis of emission of said water and discharging said dry binder from said binder injector into said soil formation along an axis of emission of said dry binder under control of the rate of supply of each, both said axes of emission being directed away from said shaft tool into said soil formation at a respective location along said central axis of said shaft, so that said water and said dry binder being emitted from said water injector and from said binder injector, respectively, will during a limited number of revolutions of said shaft encounter one another to become a mixture at respective depths as a predetermined ratio of water and dry binder, said ratio being responsive to requirements at the respective depth, said required water including water emitted from said water injector and water which may have already been present at that depth in said soil formation, said resulting mixture of water and binder further including material of the soil formation.

4. The method of claim 3 in which injection of binder is made during passage of said tool into said soil formation.

5. The method of claim 3 in which injection of binder is made during passage of said tool out of said soil formation.

6. The method of claim 3 in which injection of water is made during passage of said tool into said soil formation.

7. The method of claim 3 in which injection of water is made during passage of said tool out of said soil formation.

8. The method of claim 3 in which the emission of one of said injectors is encountered in said soil formation in a temporally suitable time related to the curing of the binder and drainage of the water.

9. The method of claim 3 in which the emission of water is determined by a program responsive to data from a representative core.

10. The method of claim 3 in which the emission of water is determined by a program responsive to data relating to water content already in the soil derived from a sensor on said tool disposed at an axial location below the place of injection of said binder.

11. The method of claim 3 in which the pressure of the stream of water and of the binder in the tool is above the ambient pressure which exists in the formation.

12. The method of claim 3 in which emission of water and binder are under continuous control.

13. A method according to claim 3 in which the emission of water and binder are under continuous adjustable control.

* * * * *